US005360245A

United States Patent [19]

David et al.

[11] Patent Number: 5,360,245

[45] Date of Patent: Nov. 1, 1994

[54] REMOVABLE DOOR LOCK FOR HOTELS AND THE LIKE

[76] Inventors: Johnnie David; Melanise David, both of 29 Heather Way, Ventura, Calif. 93004

[21] Appl. No.: 199,641

[22] Filed: Feb. 22, 1994

[51] Int. Cl.[5] ..... E05C 19/18

[52] U.S. Cl. ..... 292/289; 292/297

[58] Field of Search ..... 292/292, 258, 297, 295, 292/288, 289, 296, 290, 298

[56] References Cited

U.S. PATENT DOCUMENTS

| | | | |
|---|---|---|---|
| 692,083 | 1/1902 | Spear | 292/292 |
| 827,624 | 7/1906 | Foster | 292/288 |
| 866,548 | 9/1907 | Wilkinson | 292/292 |
| 892,462 | 7/1908 | Stewart | 292/297 |
| 2,019,217 | 10/1935 | Forte | 292/292 |
| 2,532,586 | 12/1950 | Wickwire | 292/290 X |
| 2,786,705 | 3/1957 | Stalmer | 292/297 |
| 3,421,787 | 1/1969 | Hoffman et al. | 292/289 |
| 4,386,797 | 6/1983 | Duran, Sr. | 292/292 |
| 4,471,981 | 9/1984 | Wright | 292/295 X |
| 4,575,140 | 3/1986 | Dargis | 292/296 X |

*Primary Examiner*—Rodney M. Lindsey
*Attorney, Agent, or Firm*—Robert M. Sperry

[57] ABSTRACT

An improved security device comprising a plate member insertable between a door and a door jamb and having a first portion projectable into a latch recess in said jamb and having a recess located adjacent said door when said first portion is located in said recess, and a second member releasably engageable with said recess of said plate member and with the doorknob of said door to prevent unauthorized opening of said door.

9 Claims, 4 Drawing Sheets

REMOVABLE DOOR LOCK FOR HOTELS AND THE LIKE

BACKGROUND

1. Field of Invention

This invention relates to door locks and is particularly directed to removable locks for providing security to hotel room occupants and the like.

2. Prior Art

It is often necessary or desirable for a person to be able to ensure their safety and privacy by locking doors. This is especially true when a person is travelling and is staying in hotels, motels and the like. Although such establishments often provide interior security devices, such as dead bolts, chains and the like, which may be secured from within the room by a patron or the like, it is also well known that some persons, such as hotel employees, have master keys and the like which are capable of overriding the interior security devices. It is also true that criminals and other unscrupulous persons can obtain or create such override devices. Consequently, the traveller can never completely rely on the security devices provided by the hotel, motel or the like. Numerous devices have been proposed heretofore for ensuring the ability of a person to securely lock the doors of hotels, motels and the like. However, many of the prior art security devices have been expensive to purchase and have been complex to install and remove. Some prior are security devices have required permanent installation and, hence, have not been capable of being moved by a traveller from one location to another. Thus, none of the prior art temporary security devices have been entirely satisfactory.

BRIEF SUMMARY AND OBJECTS OF INVENTION

These disadvantages of the prior art are overcome with the present invention and an improved security device is provided which is simple in construction, economical to purchase and can be installed and removed quickly and easily by persons having no technical ability.

The advantages of the present invention are preferably attained by providing an improved security device comprising a plate member insertable between a door and a door jamb and having a first portion projectable into a latch recess in said jamb and having a recess located adjacent said door when said first portion is located in said recess, and a second member releasably engageable with said recess of said plate member and with the doorknob of said door to prevent unauthorized opening of said door.

Accordingly, it is an object of the present invention to provide an improved security device.

Another object of the present invention is to provide an improved security device which may be used to provide temporary security in hotels, motels and the like.

An additional object of the present invention is to provide an improved security device which may be used to provide temporary security in hotels, motels and the like and may subsequently be removed for use in another location.

A further object of the present invention is to provide an improved security device for use by travellers and the like to ensure their safety and privacy in hotels, motels and the like.

Another object of the present invention is to provide an improved security device which is simple in construction.

An additional object of the present invention is to provide an improved security device which is economical to purchase.

A further object of the present invention is to provide an improved security device which can be installed and removed quickly and easily by persons having no technical ability.

A specific object of the present invention is to provide an improved security device comprising a plate member insertable between a door and a door jamb and having a first portion projectable into a latch recess in said jamb and having a recess located adjacent said door when said first portion is located in said recess, and a second member releasably engageable with said recess of said plate member and with the doorknob of said door to prevent unauthorized opening of said door.

These and other objects and features of the present invention will be apparent from the following detailed description, taken with reference to the figures of the accompanying drawing.

DETAILED DESCRIPTION OF THE INVENTION

Figure 1:
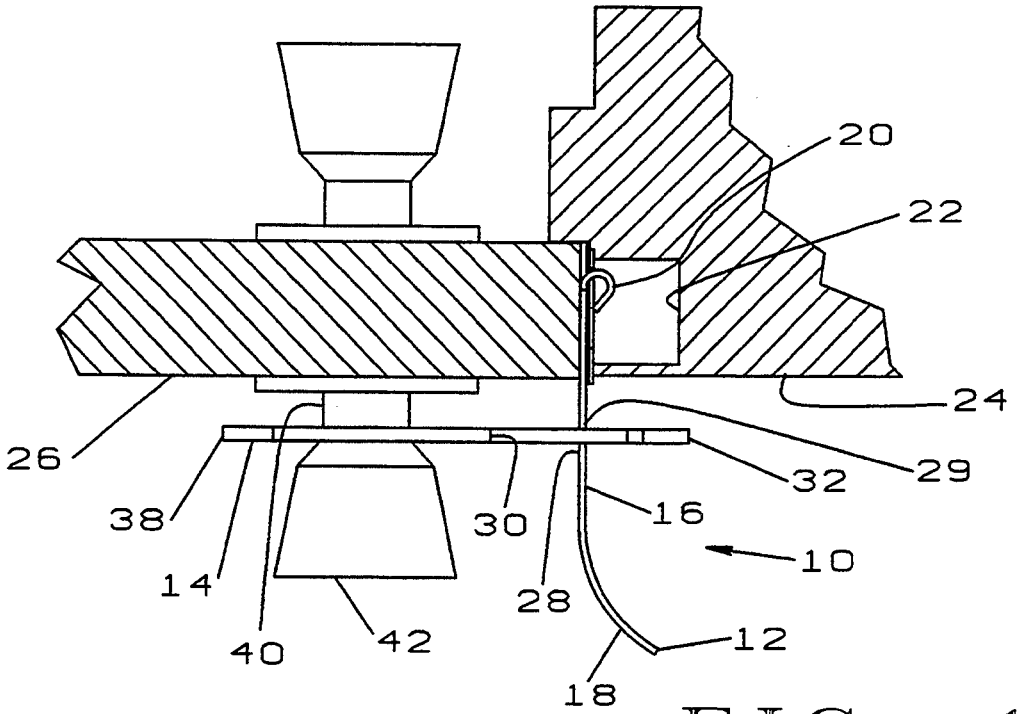
FIG. 1 is a horizontal section through a door and jamb which the security device of the present invention installed.
Figure 2:
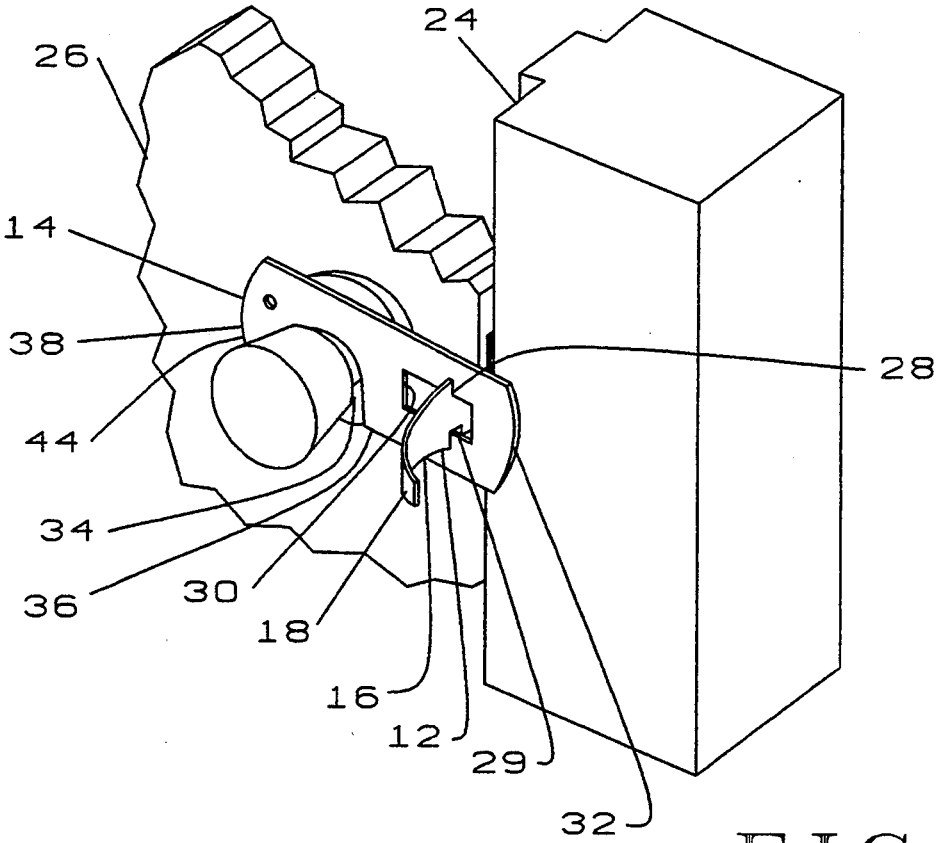
FIG. 2 is a diagrammatic side view showing the security device of FIG. 1.
Figure 3:
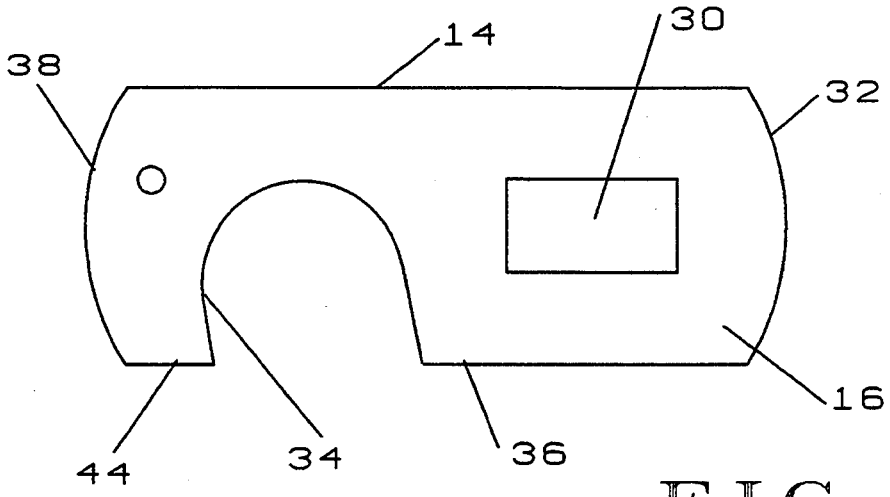
FIG. 3 is a side view of the latching member of the security device of FIG. 1.
Figure 4:
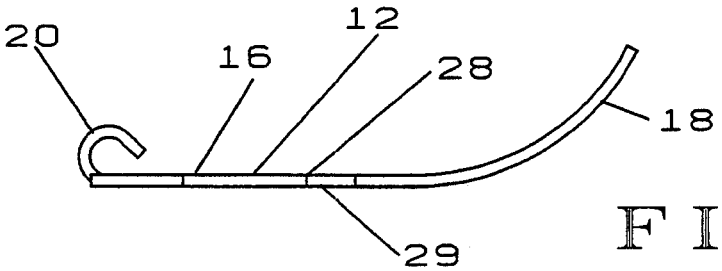
FIG. 4 is a plan view of the insert member of the security device of FIG. 1.
Figure 5:
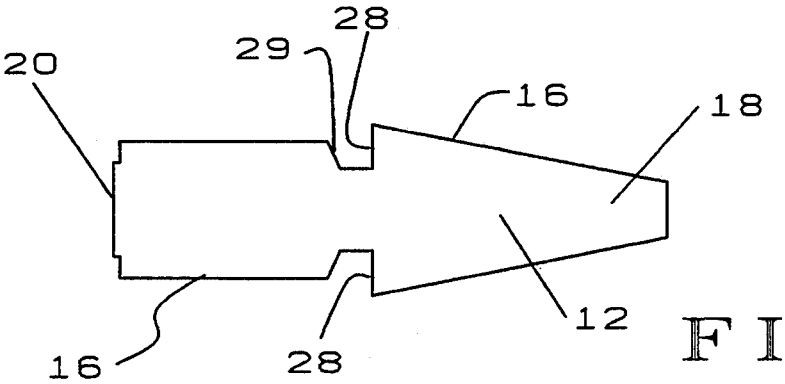
FIG. 5 is a side view of the insert member of FIG. 4.

In that form of the present invention chosen for purposes of illustration, FIG. 1 shows a security device, indicated generally at 10, comprising an insert member 12 and a latching member 14. The insert member 12 is a relatively flat strip 16 of rigid material, such as metal, with a curved end portion 18 and having portion 20 which projects laterally from the strip 16 and which is insertable into the latch recess 22 of a door jamb 24. As best seen in FIG. 5, the strip 16 is dimensioned to fit between a door 26 and the adjacent jamb 24 and is formed with a recesses 28 in the upper and lower edges of the strip 16 which define a neck portion 29. The latching member 14 is a flat plate formed with a rectangular opening 30 located adjacent one end 32 of the latching member 14 extending generally axially of the latching member 14. The opening 30 is dimensioned so that the length of the opening 30 is sufficient to allow insertion and removal of the first member 12, while the width of the opening 30 is such that it will engage the recesses 28 of the first member and will prevent disengagement of the first member 12 from the opening 30 of the second member 14. The latching member 14 also has a recess 34 formed in the lower side 36 of the latching member 14 adjacent end 38 of the latching member 14. The opening 30 is long enough to slip easily over curved end 18 of the insert member 12, but has a lateral dimension which is small enough to cause the latching member 14 to engage recess 28 of the insert member 12 and to prevent disengagement of the latching member 14 from the insert member 12. Recess 34 of the latching member 14 is dimensioned to fit easily about the shank 40 of the door knob 42 of door 26 and hook portion 44 of the latching member 14 serves to prevent unauthorized disengagement of the latching member 14.

Figure 6:
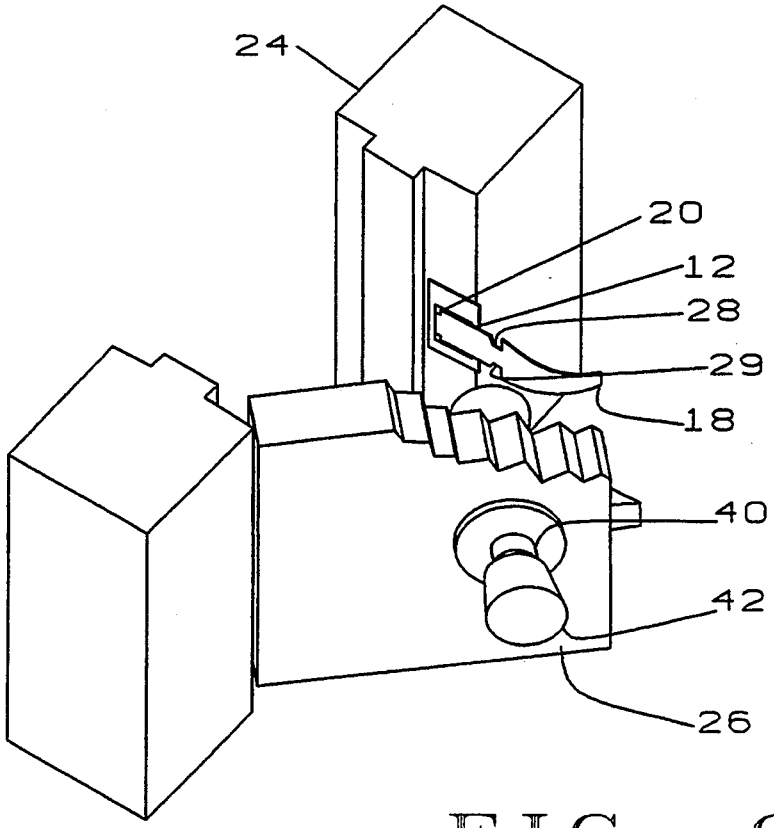
FIG. 6 is a diagrammatic representation showing the insert member of the security device of FIG. 1 inserted into the latch recess of a door jamb.
Figure 7:
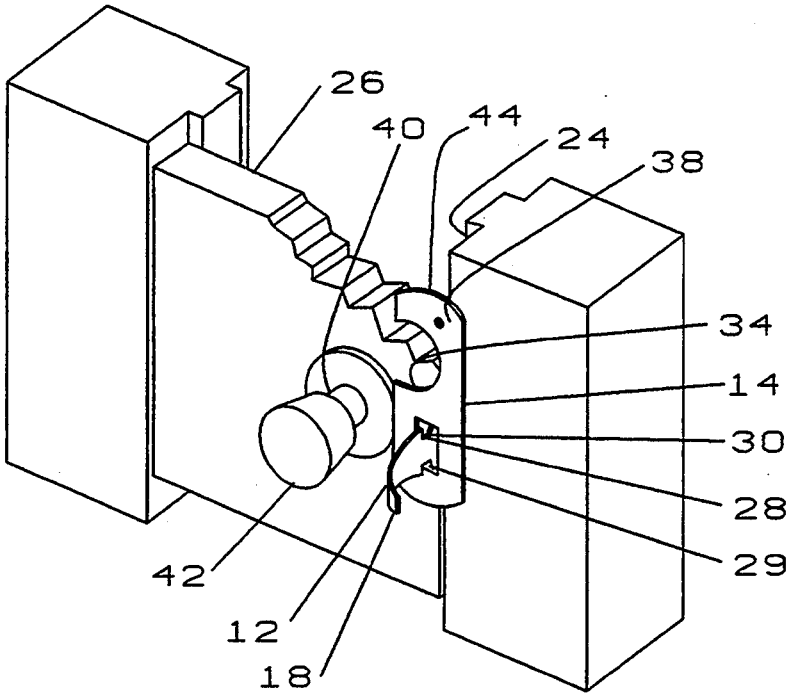
FIG. 7 is a diagrammatic representation showing the security device of FIG. 1 with the insert member projecting from between the door and the jamb and with the latching member mounted on the insert member in the unlocked position.
Figure 8:
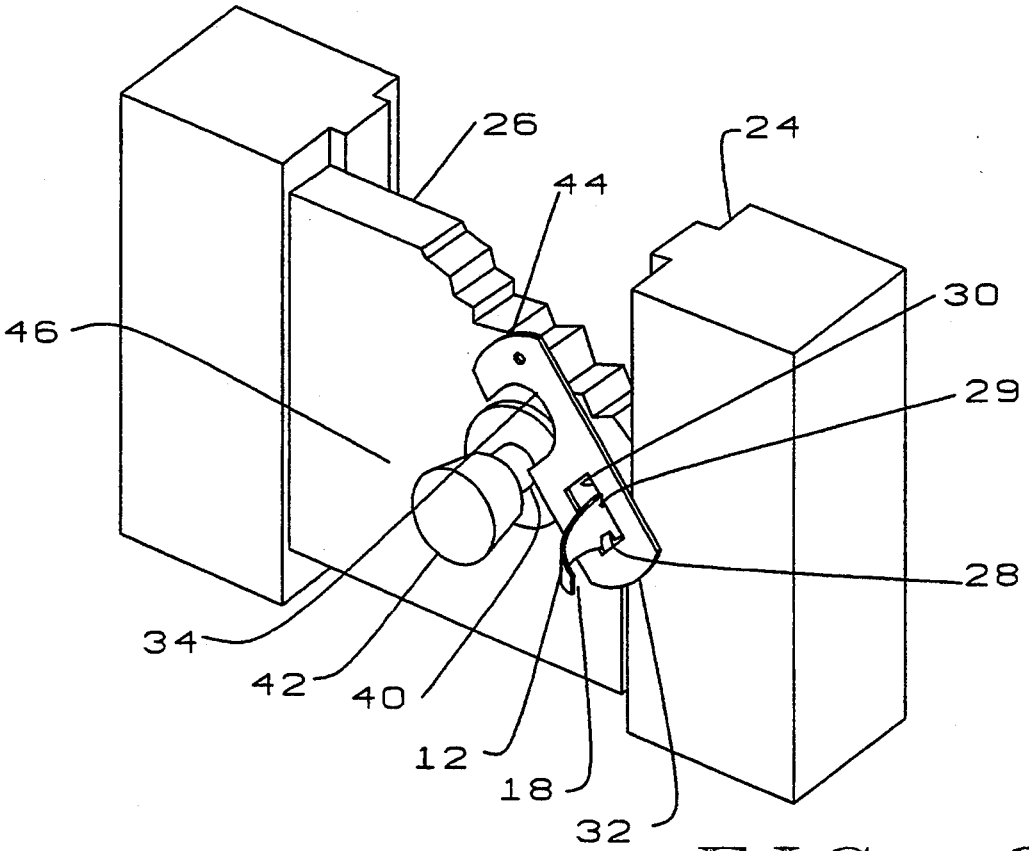
FIG. 8 is a view, similar to that of FIG. 7, showing the latching member during movement to the locking position.
Figure 9:
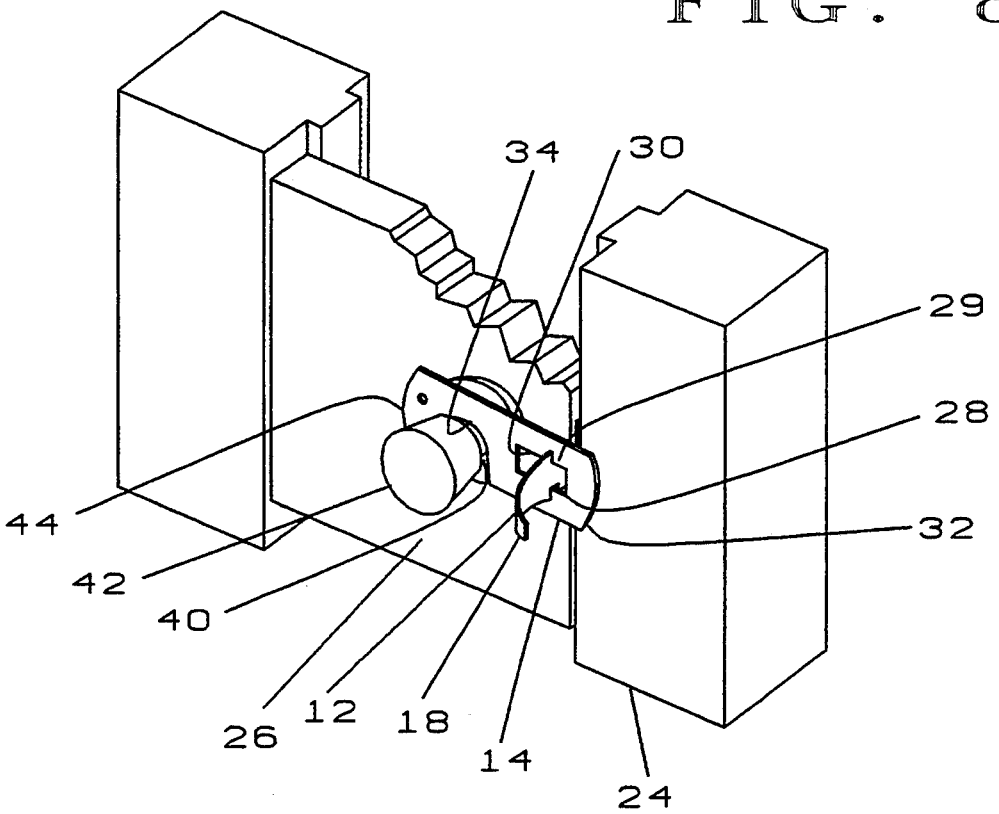
FIG. 9 is a view, similar to that of FIG. 7, showing the latching member in the locked position.

In use, the door 26 is opened and portion 20 of the insert member 12 is inserted into recess 22 of the door jamb 24, with curved end portion 18 extending into the room, as seen in FIG. 6. Next, as seen in FIG. 7, the door 26 is closed and curved end 18 of the insert member 12 is passed through opening 30 of the latching member 14 until opening 30 of the latching member 14 lies adjacent recess 28 of the insert member 12. Then, the latching member 14 is rotated, as indicated by arrow 46 in FIG. 8, to cause recess 34 to engage the shank 40 of door knob 42, as seen in FIG. 9. If any unauthorized person attempts to open the door 26, the inward movement of the door 26 will cause hook 44 of latching member 14 to engage the shank 40 of door knob 42 and will cause the edges of opening 30 of the latching member 14 to bear against the edges of recess 28 of the insert member 12. However, such movement will cause portion 20 of the insert member 12 to engage the edges of the recess 22 in door jamb 24. Since the insert member 12 is inserted between the door 26 and the jamb 24, portion 20 of the insert member 12 cannot be moved out of the recess 22 of the door jamb 24. Consequently, the door 26 cannot be opened. To allow opening of door 26, the user simply rotates the latching member 14 in the direction opposite to arrow 46 of FIG. 8, until opening 30 of the latching member 14 is in a position to allow withdrawal of end 18 of the insert member 12. Once end 18 of the insert member 12 has been withdrawn from opening 30 of the latching member 14, the door 26 can easily be opened, as seen in FIG. 6. Since insert member 12 and latching member 14 are not permanently attached to either the door 26 or door jamb 24, the security device 10 can quickly and easily be installed or removed at the desire of the user and can conveniently be carried in a purse or pocket for use in a subsequent location.

Obviously, numerous variations and modifications can be made without departing from the spirit of the present invention. Therefore, it should be clearly understood that the form of the present invention described above and shown in the figures of the accompanying drawing are illustrative only and are not intended to limit the scope of the present invention.

What is claimed is:

1. A security device for locking a door having a doorknob to a door jamb having a latch recess, said security device comprising:

a first member insertable between said door and said door jamb when said door is closed and formed with a first portion projectable into said latch recess and having a second portion which projects beyond an edge of said jamb and the first member defining a first edge and a second edge extending from the first portion to the second portion and defining a width between the edges and having at least one recess formed in at least one edge thereof, and a second member releasably engageable with said first member and with the doorknob of said door to prevent unauthorized opening of said door and formed with an elongated opening having a first dimension greater than the width of said first member to allow said elongated opening to slideably receive said first member and a second dimension less than the width of said first member and engageable with the recess of said first member to prevent disengagement of said first member from said second member.

2. The security device of claim 1 wherein: said second member is a metal plate.

3. The security device of claim 1 wherein:

said second member is movable between a first position allowing engagement and disengagement with said first member and a second position preventing disengagement.

4. The security device of claim 1 wherein:

said first member is formed of rigid material.

5. The security device of claim 1 wherein:

said first member is a metal plate.

6. The security device of claim 1 wherein:

said second member is rigid.

7. The security device of claim 1 wherein:

said first member is a plate and said first portion is a recurved portion insertable into said recess of said jamb.

8. The security device of claim 7 wherein:

said first member is formed with two recesses one in each edge thereof defining a neck portion, and said second member is movable between a first position releasably engageable with said recesses and a second position preventing disengagement of said neck portion from said second member.

9. The security device of claim 7 wherein:

said first member has a curved portion projectable beyond the edge of said jamb and curved toward said jamb.

* * * * *